US010352123B2

(12) United States Patent
Landry

(10) Patent No.: US 10,352,123 B2
(45) Date of Patent: Jul. 16, 2019

(54) WELLHEAD SAFETY VALVE ASSEMBLY

(71) Applicant: Harold Wayne Landry, Lafayette, LA (US)

(72) Inventor: Harold Wayne Landry, Lafayette, LA (US)

( * ) Notice: Subject to any disclaimer, the term of this patent is extended or adjusted under 35 U.S.C. 154(b) by 190 days.

(21) Appl. No.: 14/700,702

(22) Filed: Apr. 30, 2015

(65) Prior Publication Data

US 2015/0315869 A1 Nov. 5, 2015

Related U.S. Application Data

(60) Provisional application No. 61/986,177, filed on Apr. 30, 2014.

(51) Int. Cl.

| | |
|---|---|
| ***E21B 33/03*** | (2006.01) |
| ***E21B 33/04*** | (2006.01) |
| ***E21B 34/00*** | (2006.01) |
| ***E21B 34/02*** | (2006.01) |

(52) U.S. Cl.

CPC ..... *E21B 33/04* (2013.01); *E21B 33/03* (2013.01); *E21B 34/02* (2013.01); *E21B 2034/002* (2013.01)

(58) Field of Classification Search

CPC ..... E21B 33/03; E21B 33/04; E21B 34/02

See application file for complete search history.

(56) References Cited

U.S. PATENT DOCUMENTS 2,092,261 A 9/1937 Rector
2,205,988 A 6/1940 McEvoy et al.
3,043,371 A * 7/1962 Rector ..... E21B 33/04 166/97.1
3,193,308 A * 7/1965 Todd ..... E21B 33/04 285/123.3
3,494,638 A * 2/1970 Todd ..... E21B 33/03 285/123.12
5,103,900 A * 4/1992 McLeod ..... E21B 17/1007 166/88.1
5,884,706 A * 3/1999 Edwards ..... E21B 33/12 166/335
7,275,591 B2 * 10/2007 Allen ..... E21B 17/0423 166/330
7,913,754 B2 * 3/2011 Bolding ..... E21B 33/068 166/263
8,539,976 B1 9/2013 Rodgers, Jr. et al.
2003/0150620 A1 8/2003 DeBerry et al.
(Continued)

*Primary Examiner* — Giovanna C Wright
*Assistant Examiner* — Jonathan Malikasim
(74) *Attorney, Agent, or Firm* — Ted M. Anthony

(57) ABSTRACT

A valve assembly is installed within a wellhead such as a conventional tubing hanger or casing hanger used to suspend pipe or other tubular goods in a well. A seal bushing assembly is installed in a tubing head assembly or other wellhead component. A hanger valve assembly is stung into the seal bushing assembly and includes a valve that can be selectively opened or closed. In the open position, the valve does not restrict a central flow path diameter through the hanger and wellhead. In the closed position, the valve contains pressure and/or fluid flow and fully seals against wellbore pressure acting on the valve. A wellhead adapter covers the hanger valve assembly and provides an attachment point for a conventional Christmas tree or other wellhead equipment.

7 Claims, 14 Drawing Sheets

(56) References Cited

U.S. PATENT DOCUMENTS

| | | | | |
|---|---|---|---|---|
| 2006/0060348 | A1 | 3/2006 | Allen et al. | |
| 2007/0204999 | A1 | 9/2007 | Cowie et al. | |
| 2010/0252251 | A1* | 10/2010 | Harkins | E21B 33/02 166/85.1 |
| 2011/0259597 | A1* | 10/2011 | Bjerke | E21B 33/0355 166/368 |
| 2013/0014947 | A1* | 1/2013 | Wilkins | E21B 43/26 166/281 |

* cited by examiner

WELLHEAD SAFETY VALVE ASSEMBLY

CROSS REFERENCES TO RELATED APPLICATION

Priority of U.S. Provisional Patent Application Ser. No. 61/986,177, Filed Apr. 30, 2014, Incorporated Herein by Reference, is Hereby Claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a valve or other barrier that can be selectively operated to contain wellbore or induced pressures and/or flow within a well. More particularly, the present invention pertains to a valve or other sealing barrier located within or in proximity to a wellhead that can be selectively opened to permit any flow through said wellhead, or closed to prevent such flow and contain pressures and/or flow within said well.

2. Brief Description of the Related Art

Oil, gaseous products, water, and/or geothermal water or steam wells are typically drilled from a drilling rig or other surface facility to a desired depth within the earth's crust. After a well has been drilled to such depth, relatively large and/or heavy pipe known as casing is installed into the well and cemented in place. Thereafter, a wellhead assembly is typically installed at or near the earth's surface, usually on the upper end of the casing string.

In most cases, wellheads provide a structural and pressure-containment interface between down hole and surface components of a well. Conventional wellheads generally include a through-bore or opening that extends to the inner bore of a casing string. Said wellheads also generally provide a support platform or base for attaching surface pressure containment valves, commonly referred to as a "Christmas tree," to a well. In most cases, after a well has been drilled and a drilling rig has been demobilized from a well location, a Christmas tree (in cooperation with a wellhead assembly) is used to contain wellbore pressures and/or flow at the earth's surface.

In many conventional wellhead assemblies, said through bore or inner opening defines a seat profile for receiving and supporting a "hanger." Such hangers attach to the upper end of a string of tubing that extends to a desired depth in the wellbore; the hanger can be lowered into the wellhead assembly until it is received on, and supported by, said inner seat profile of said wellhead assembly. In this manner, hangers can be used to suspend and "hang" tubular strings from said wellhead assemblies.

Conventional hangers also include a through bore for permitting production and/or other wellbore production/products to flow out of the production tubing, through said hanger and Christmas tree, into surface processing equipment and, eventually, into storage tanks or flow lines. When desired, the inner surface of a hanger through bore frequently includes threads which can be used for temporary anchoring of a backpressure valve and/or test plug within such hanger through bore.

Such backpressure valves and/or test plugs can frequently be difficult to install properly. In many cases, such valves/plugs are installed while a Christmas tree is in place. In such instances, the valve/plug is inserted through the upper opening of a Christmas tree using an elongate rod that must be long enough to span the length of the Christmas tree and facilitate anchoring of a valve/plug within the through bore of a hanger situated in the wellhead beneath said tree. Unfortunately, it can often be difficult for an installer to determine whether a backpressure valve and/or test plug is seated properly within the through bore of a hanger because of the distance and lack of "feel" involved. Moreover, there is typically very little, if any, ability for visual indication to aid in the installation process or to confirm proper placement of a plug/valve within a hanger bore.

Additionally, hanger threads are often damaged otherwise not in good operating condition. In many cases, such hanger threads are exposed to wellbore production and other production/products flowing through the inner bore of the hanger. Over time, such hanger threads can be compromised by erosion, corrosion, oxidation, sand flow or other damage caused by such production/products flow or intervention activities such as wireline, coil tubing, snubbing, hydraulic fracturing, acidizing, sand pumping or other operations. In such cases, damaged hanger threads can make proper installation of backpressure valves and/or test plugs within a hanger bore especially difficult and problematic.

Although such backpressure valves and/or test plugs can be utilized for many different reasons, said valves/plugs are frequently installed to provide an additional pressure isolation or safety barrier when a Christmas tree must be removed from a wellhead. By way of illustration, but not limitation, a backpressure valve is typically installed in a hanger bore as an additional pressure and/or flow barrier before a Christmas tree is removed from a wellhead prior to installation of a blowout preventer assembly (such as when a well is being worked over, recompleted or re-drilled using a drilling rig) and vice versa.

During the period between removal of a Christmas tree and installation of a blowout preventer assembly, there are no surface valves or other equipment that can be used to shut in wellbore pressure. During these especially vulnerable periods, a backpressure valve can be the primary—or only—mechanism for keeping the pressurized wellbore production/products contained within a well and preventing a blowout or other uncontrolled release of said wellbore pressure and/or flow. However, wellbore pressure can cause said valve to fail, particularly when it is not installed properly or when a hanger's internal threads have been damaged or compromised.

Failure of a backpressure valve with no Christmas tree or blowout preventer assembly installed can lead to a blowout or other catastrophic event. Further, in such circumstances, pressure accumulating under a backpressure valve can cause the failed valve to behave like a projectile upon such failure, forcing the failed valve out of the hanger bore at a high rate of speed and presenting a serious risk of injury or death to personnel in the vicinity of the well.

Thus, there is a need for an effective means for providing an additional pressure and/or flow barrier within a wellbore. The pressure and/or flow barrier should be safe, convenient and easy to operate. Further, said pressure barrier should provide an additional means for preventing undesired release or leakage of pressurized wellbore production/products, particularly during periods between removal of a Christmas tree and installation of a blowout preventer assembly and testing of well equipment and vice versa.

SUMMARY OF THE INVENTION

The present invention comprises a wellhead valve assembly that can be utilized in connection a conventional wellhead or other similar equipment. The wellhead valve assembly of the present invention allows for the selective shutting-in of wellbore flow and containment of wellbore pressure and/or flow. When desired, said wellhead valve assembly of the present invention can also optionally be used to hang or suspend a string of pipe (typically production tubing or casing) within a wellbore.

In a preferred embodiment, the wellhead valve assembly of the present invention comprises a plurality of cooperating components. Although such components can be arranged differently to meet alternative equipment configuration requirements or job design parameters, in many cases said components of the wellhead valve assembly of the present invention generally comprise a seal bushing assembly, a hanger valve assembly and a wellhead adapter member.

A seal bushing assembly can be landed within the inner bore or internal seat profile of a conventional wellhead assembly over a wellbore such as, for example, a tubing head assembly or similar wellhead component having a central bore. A central through bore extends through said seal bushing assembly, substantially coaxially with the central bore of said tubing head assembly, for receiving the upper end of a string of production tubing extending into said wellbore.

Said seal bushing assembly includes sealing members constructed of elastomeric material, rubber or other suitable sealing material for providing an "external" pressure and/or flow seal against the inner bore of said tubing head assembly, as well as an "internal" pressure and/or flow seal against the outer surface of said production tubing. In a preferred embodiment, said seal bushing assembly also has a plurality of transverse bores, oriented substantially perpendicular to said central through bore. Said transverse bores are aligned with similar transverse bores extending through said tubing head assembly, and are adapted to receive hold down pins; said hold down pins serve the purpose of aligning and anchoring said seal assembly relative to said tubing head assembly.

A hanger valve assembly is partially received within an upper receptacle of said seal bushing assembly; lugs protruding from the inner surface of said receptacle can operationally mate with slots disposed on the outer surface of said hanger valve assembly to align and anchor said hanger valve assembly relative to said seal bushing assembly. Said hanger valve assembly beneficially has a threaded connection for operational attachment to the upper end of a tubing string. Further, said hanger valve assembly further includes a central through bore having internal threads for receiving a backpressure valve (such as, for example, a conventional backpressure valve used in connection with conventional tubing hangers) and a profile nipple or second screw type back pressure valve/plug. In total valve assembly can accommodate a plurality of protective barriers and assure that none can become dislodged projectiles and ejected from the wellbore area.

Said hanger valve assembly further comprises a valve assembly. Said valve assembly is capable of selectively shutting-off (or controlling) production/products flow through said production tubing and central through bore of said hanger valve assembly. When open, said valve assembly does not create any substantial diameter restriction along said central through bore of said hanger valve assembly. When closed, said valve can contain production/products flow and fully seal against wellbore pressure acting on said valve (such as, for example, downhole reservoir pressure communicated through said production tubing).

A wellhead adapter having a central through bore is received over said hanger valve assembly and a portion of said seal bushing assembly, and secured to said tubing head assembly using threaded bolts or other attachment means. Sealing members constructed of elastomeric material, rubber or other suitable sealing material and disposed along said central through bore of said wellbore adapter provide a pressure and/or flow seal against the outer surface of said hanger valve assembly.

A valve actuator can be operationally attached to or integrally made into the said wellhead adapter to selectively actuate (open or close) the valve of said hanger valve assembly. A Christmas tree or other wellhead component can be secured above said wellhead adapter using threaded bolts or other attachment means. Further, an injection port can extend through said wellhead adapter from the outer surface of said wellhead adapter to said central through bore of said wellbore adapter.

Said port can have multiple check valve inserts and a fitting to allow testing or chemical injection to treat and protect wellhead valves, flowline, production equipment and pipelines downstream of said injection port. Said port also allows for an equalization port when said safety valve assembly has closed; fluid can be pumped through said injection port to equalize pressure across the safety valve assembly (without the need for a large or specialized pump) to allow said valve assembly to be opened. Said safety valve may have a specially designed ball valve having equalization ports that allows for pressure equalization and assistance in re-opening the safety valve assembly after being closed with differential pressure across said ball.

The wellhead valve assembly of the present invention can be optionally retrofit to accommodate existing wellhead equipment. Moreover, although said wellhead valve assembly can be installed for temporary or short-term use, it is also capable of being utilized in connection with permanent or long-term well installation applications.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

As discussed above, the present invention comprises a valve assembly that can be utilized in connection a wellhead, casing spool, tubing spool or other similar equipment, while permitting the selective shutting-in of wellbore production/products flow, as well as containment of wellbore pressure. The wellhead valve assembly of the present invention represents an additional well control option which can complement, or in certain circumstances even replace, use of conventional downhole plugs, subsurface safety valves and wellhead-installed backpressure valves and/or test plugs. Further, the wellhead valve assembly of the present invention can also be used to facilitate quick and efficient testing of blow out preventer assemblies and Christmas tree valves, with or without use of tubing check valves or tubing/casing plugs.

Although the wellhead valve assembly of the present invention can be utilized in connection with multiple different types, sizes and configurations of wellhead assemblies and tubular goods without departing from the scope of the invention, said wellhead valve assembly is described herein primarily in connection with production tubing and accompanying tubing head assemblies. When utilized in connection with production tubing, the wellhead valve assembly of the present invention can be used to hang or suspend such production tubing from a tubing head assembly. Notwithstanding the foregoing, it is to be observed that the wellhead valve assembly of the present invention can also be beneficially used in connection with casing strings, tubing-less completions and/or other applications including, without limitation, applications that do not require the use of production tubing, or the hanging or suspension of tubular goods within a wellbore.

Figure 5:
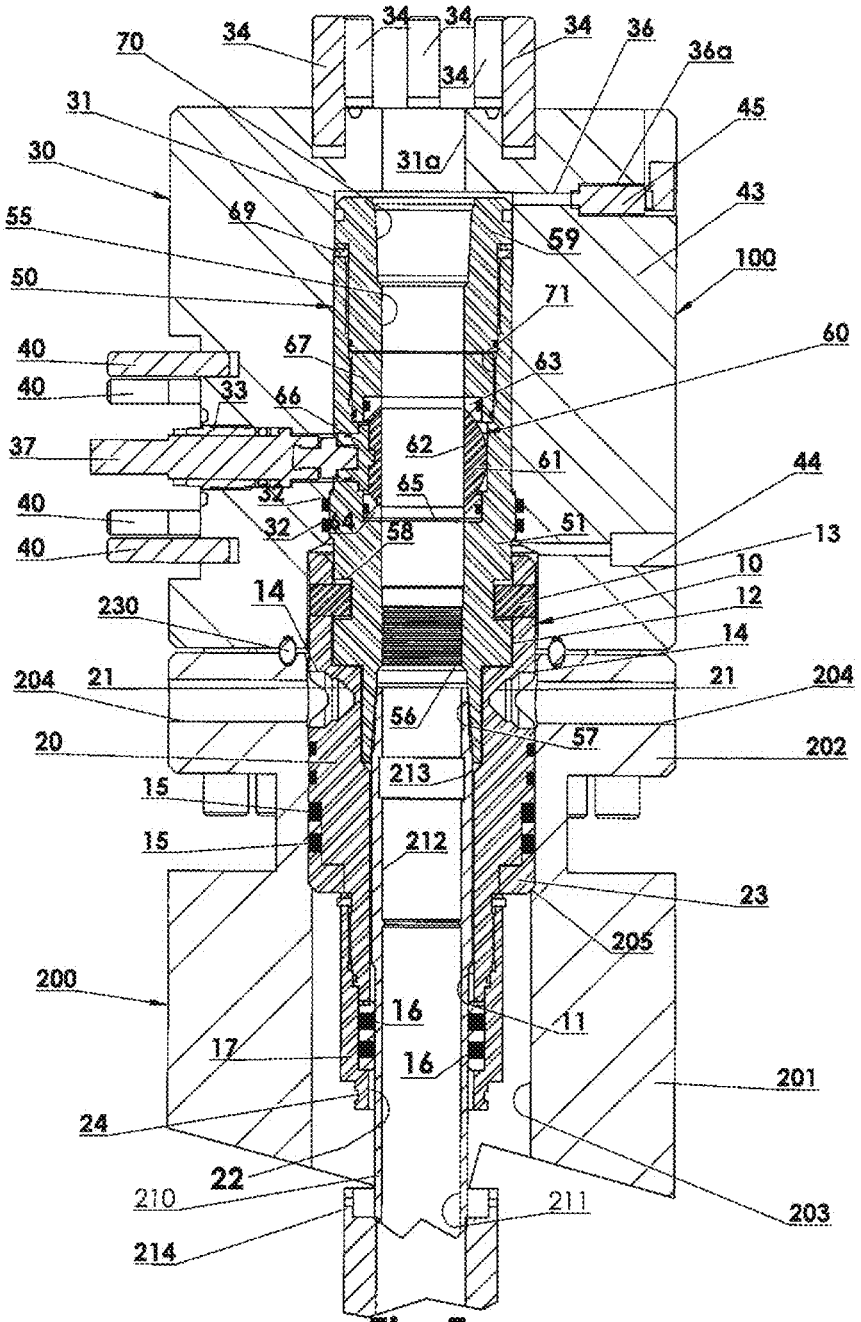
FIG. 5 depicts a side sectional view of an assembled wellhead valve assembly of the present invention installed in connection with a conventional tubing head assembly with a valve assembly in an open position.

In a preferred embodiment, the wellhead valve assembly of the present invention comprises a plurality of individual cooperating components. However, such components can be arranged differently, or constructed as an integrally formed alternative embodiment, in order to meet particular equipment configuration requirements or job design parameters. Referring briefly to FIG. 5, said cooperating components of the wellhead valve assembly 100 of the present invention generally comprise a seal bushing assembly 10, a hanger valve assembly 50 and a wellhead adapter 30.

Figure 1:
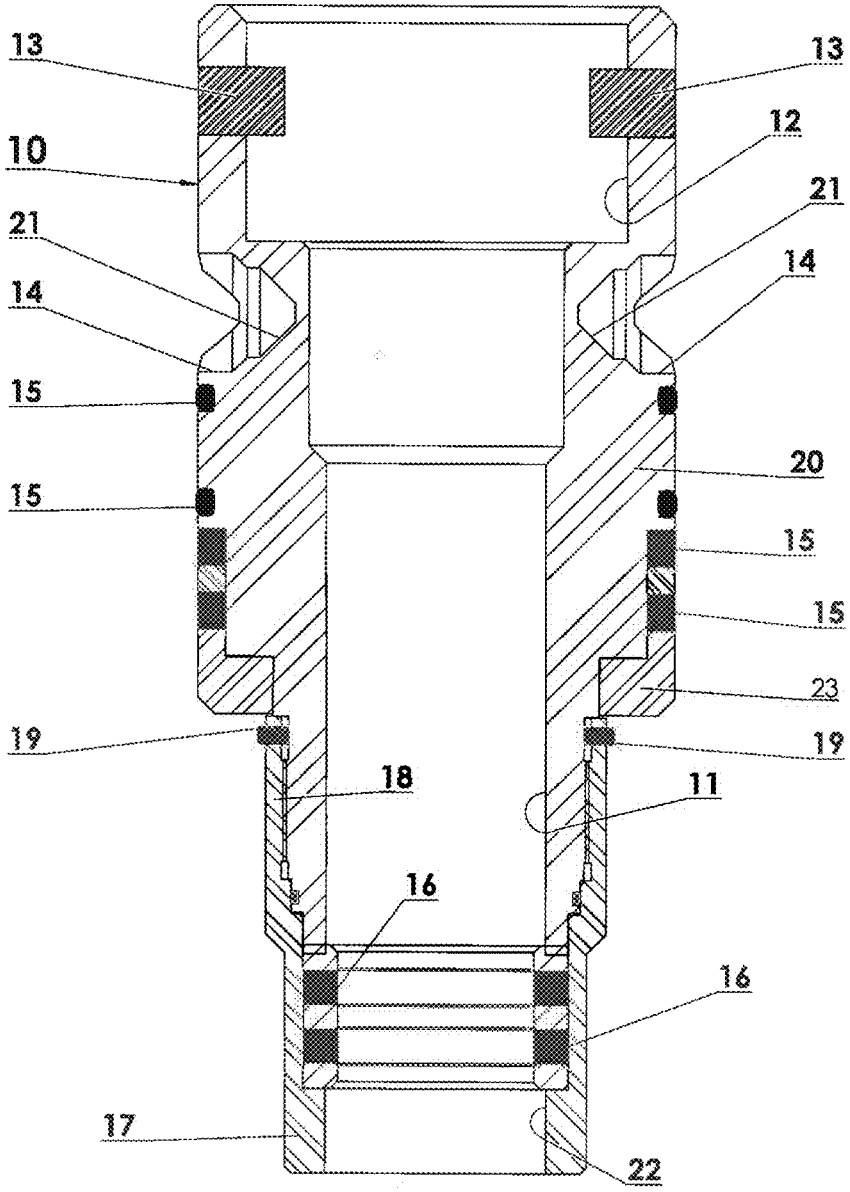
FIG. 1 depicts a side sectional view of a seal bushing (packer) assembly of the present invention.

FIG. 1 depicts a side sectional view of a seal bushing assembly 10 of the present invention. Said seal bushing assembly 10 comprises body member 20 having central through bore 11. Upper receptacle 12 is positioned near the upper end of central through bore 11, and has lugs 13 extending inward into said upper receptacle 12. Seal members 15, constructed of elastomeric material, rubber or other suitable sealing material, are adapted to provide an "external" pressure and/or flow seal against the inner surface of a surrounding tubing head assembly. Compression cap 23 is disposed below seal members 15.

In a preferred embodiment, said seal bushing assembly 10 also has a plurality of transverse alignment bores 14 having tapered inner surfaces 21. Said alignment bores 14 are oriented substantially perpendicular to the longitudinal axis of central through bore 11. Said transverse bores 14 are aligned with transverse hold-down pin bores extending through a tubing head assembly (not depicted in FIG. 1). Said bores 14 are adapted to receive hold-down pins in a manner well known to those having skill in the art; when engaged inward, said hold-down pins can beneficially align and anchor said seal bushing assembly 10 relative to a surrounding tubing head assembly.

Seal extension 17 having central through bore 21 is connected to body member 20 using threaded connection 18 and set screws 19. In a preferred embodiment, said threaded connection 18 utilizes left handed threads to prevent unintentional disconnection of said components. Internal sealing members 16 are disposed along the inner surface of central through bore 21 of seal extension 17. Said sealing members 16 are constructed of elastomeric material, rubber or other suitable sealing material, are likewise adapted to provide an "internal" pressure and/or flow seal against the outer surface of production tubing or polished pipe joints aligned with said sealing members 16.

If desired, additional seal sections (having additional sealing members 16) can be optionally added to seal extension 17 in order to increase the length of said seal extension 17. Further, the length of polished tubular goods adjacent to said seal extension 17 can likewise be adjusted to increase or decrease such length. In this manner, the stroke length of the pressure and/or flow seal associated with seal extension 17 (that is, the distance that tubular goods can travel while maintaining a pressure seal at seal extension 17) can be adjusted.

Figure 2:
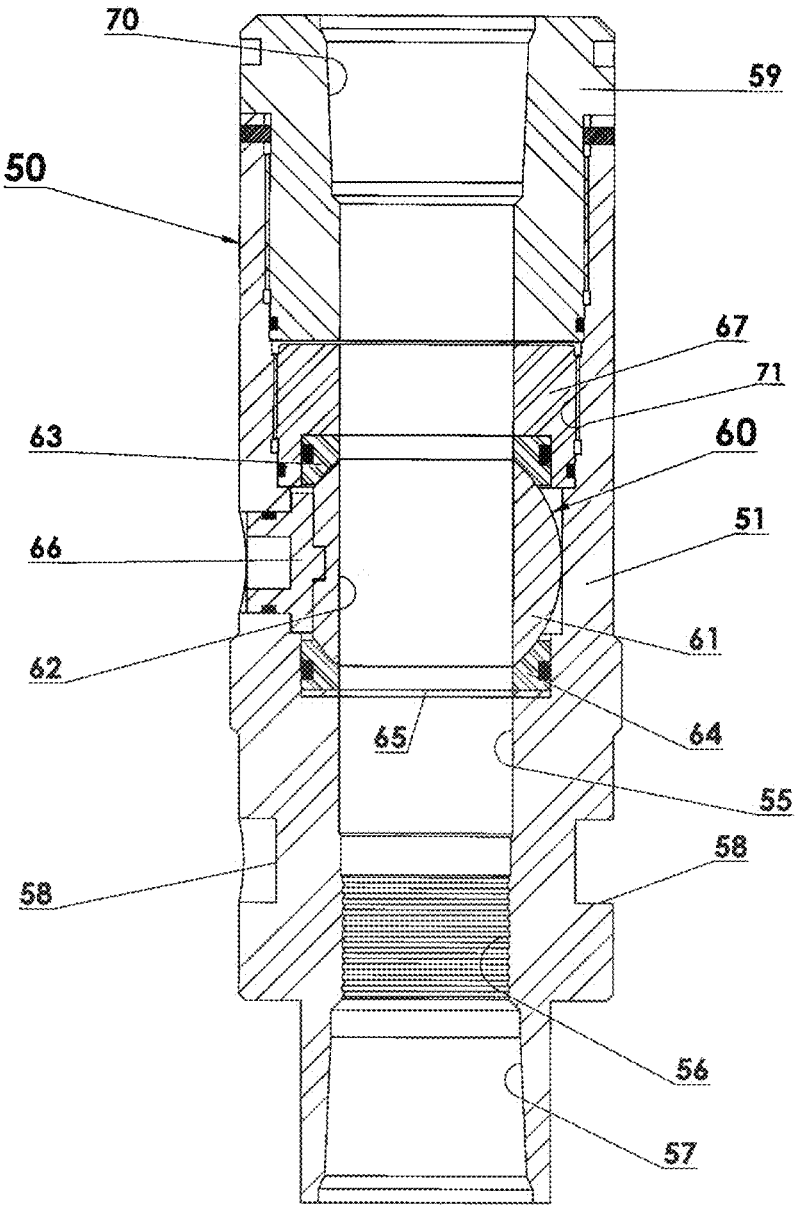
FIG. 2 depicts a side sectional view of a hanger valve assembly of the present invention with a valve assembly in an open position.

FIG. 2 depicts a side sectional view of a hanger valve assembly 50 of the present invention with a valve assembly in an open position. Hanger valve assembly 50 generally comprises a mandrel body 51 having a central through bore 55. Referring back to FIG. 1, when operationally installed, a portion of said mandrel body 51 is capable of being received within upper receptacle 12 of seal bushing assembly 10 depicted in FIG. 1. Lug extensions 13 protruding from the inner surface of upper receptacle 12 of seal bushing assembly 10 can operationally mate with J-slot tracks 58 disposed on the outer surface of said mandrel body 51 of hanger valve assembly 50 to properly align and anchor said hanger valve assembly 50 relative to seal bushing assembly 10.

Hanger valve assembly 50 beneficially has a threaded connection member 57 (typically a box-end threaded connection) for operational attachment to the upper end (typically a pin-end threaded connection) of a tubing string. Further, said hanger valve assembly 50 further includes internal threads 56 for receiving a backpressure valve or plug (such as, for example, a conventional backpressure valve used in connection with conventional tubing hangers).

Still referring to FIG. 2, hanger valve assembly 50 further comprises a valve assembly 60. In a preferred embodiment, said valve assembly 60 generally comprises a ball valve; however, it is to be observed that other valve configurations or types can be utilized without departing from the scope of the present invention. Said valve assembly 60 generally comprises rotatable ball 61 having central bore 62 that is disposed between upper ball seat 63 and lower ball seat 64. Ball 61 is beneficially constructed of corrosion and/or erosion resistant material. Upper seat bushing 67 is disposed between said upper ball seat 63 and top sub 59.

Control pin 66 is in operational engagement with ball 61, such that axial rotation of control pin 66 will, in turn, cause rotation of ball 61 about a substantially horizontal axis. Ball 61 can be selectively rotated between a first (open) position wherein bore 62 is generally aligned with central through bore 55, and a second (closed) position wherein bore 62 is not aligned with said central through bore 55.

Figure 3:
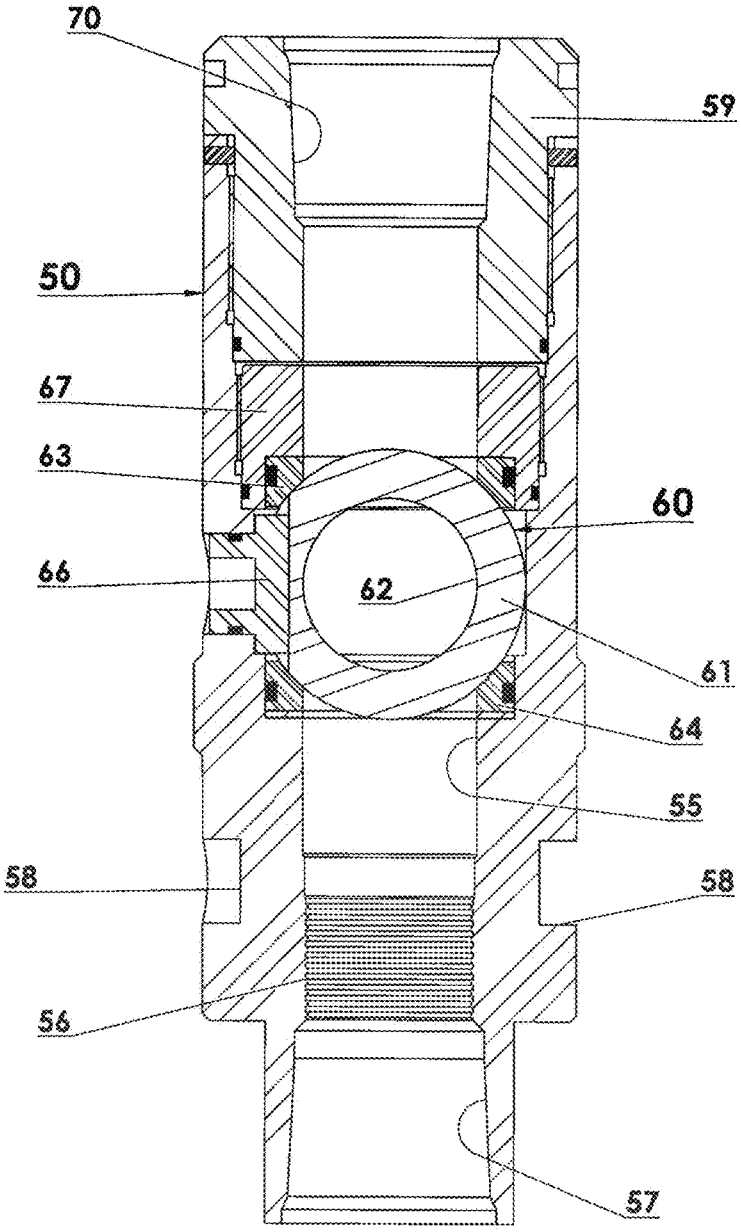
FIG. 3 depicts a side sectional view of a hanger valve assembly of the present invention with a valve assembly in a closed position.

FIG. 3 depicts a side sectional view of a hanger valve assembly 50 of the present invention with valve assembly 60 in said second, closed position. As depicted in FIG. 3, in said closed position, ball 61 cooperates with upper ball seat 63 and lower ball seat 64 to form a flow barrier and pressure and/or flow seal across said central through bore 55.

Ball 61 of valve assembly 60 is capable of selectively shutting-off (or controlling) flow through production tubing, as well as any aligned central through bore of any associated wellhead components. When in the open position, valve assembly 60 (and, more specifically, ball 61) does not create any substantial diameter restriction along aligned through bores of any wellhead components and/or production tubing. When closed, valve assembly 60 can contain production/products flow and fully seal against wellbore pressure acting on said valve (such as, for example, downhole reservoir pressure communicated through said production tubing), as well as pressure imparted—typically pumped—from above valve assembly 60.

Figure 4:
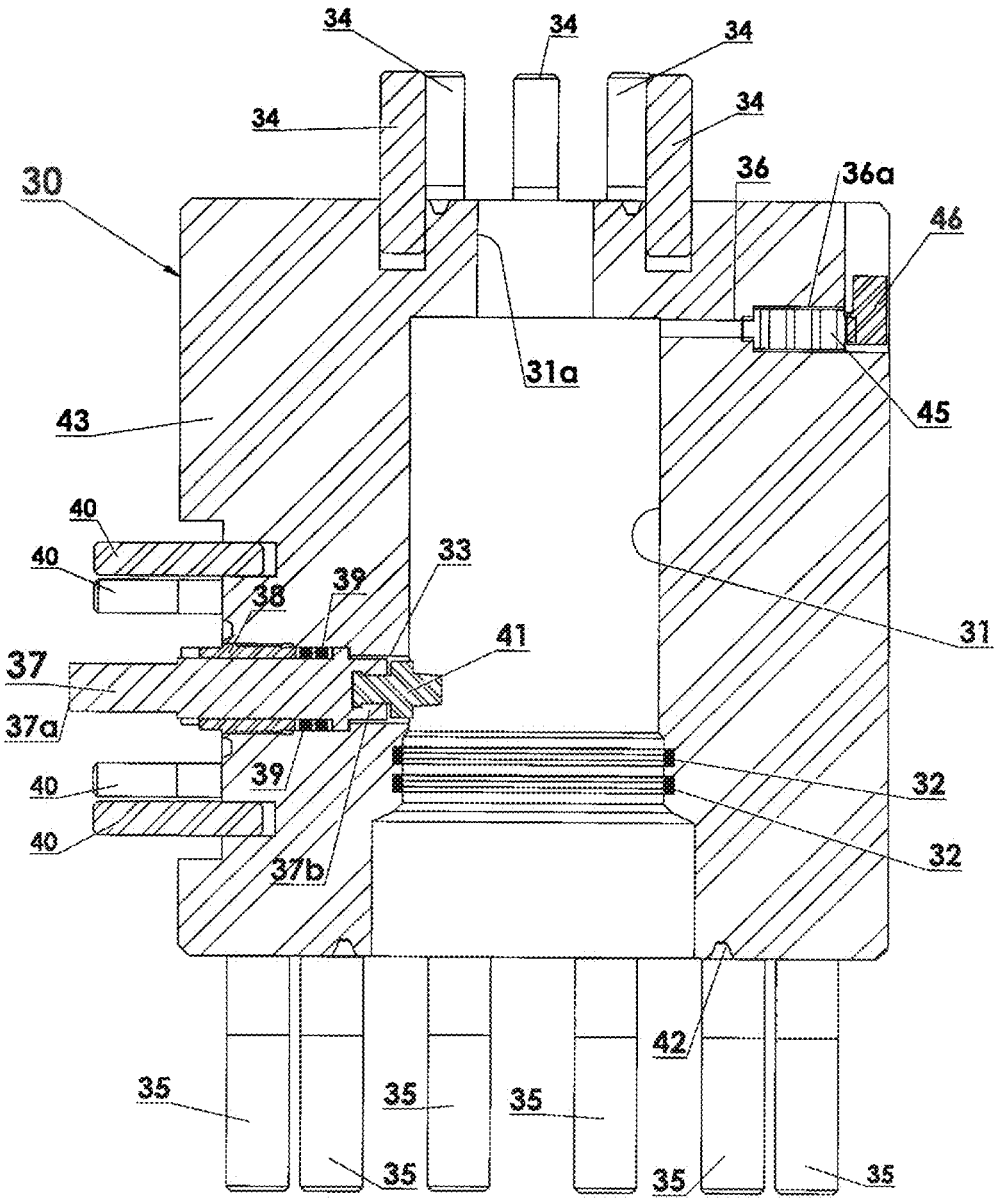
FIG. 4 depicts a side sectional view of a wellhead adapter of the present invention.

FIG. 4 depicts a side sectional view of a wellhead adapter 30 of the present invention. Referring to FIG. 4, wellhead adapter 30 has a body section 43 and central through bore 31, including upper flow bore 31*a*, extending there through. Although not depicted in FIG. 4, when fully installed, portions of hanger valve assembly 50 (depicted in FIG. 2) and seal bushing assembly 10 (depicted in FIG. 1) are received within said central through bore 31; wellhead adapter 30 can be secured to an adjacent tubing head assembly using threaded bolts 35 or other attachment means well known to those having skill in the art. In such installation, a gasket or seal ring can be received within seal ring groove 42. Sealing members 32, constructed of elastomeric material, rubber or other suitable sealing material and disposed along said central through bore 31 of wellhead adapter 30 are adapted to provide a pressure and/or flow seal (notably against the outer surface of hanger valve assembly 50, depicted in FIGS. 2 and 3, when installed within said through bore 31).

Still referring to FIG. 4, transverse bore 33 extends from the outer surface of wellhead adapter assembly 30 to central bore 31. Drive shaft 37 having proximate end 37*a* and distal end 37*b* is rotatably disposed within said transverse bore 33. In a preferred embodiment, drive shaft 37 includes drive shaft packing gland 38 and seal members 39; such packing and seal members can be substantially or entirely contained within drive shaft bore 33. Seal members 39, which are beneficially constructed of elastomeric material, rubber or other suitable sealing material, are adapted to provide a pressure and/or flow seal between drive shaft 37 and the inner surface of transverse bore 33. Connecting rod coupling 41 is attached to distal end 37*b* of drive shaft 37, and can be operationally coupled with a valve mechanism (such as, for example, control pin 66 attached to ball 61 of valve assembly 60 being a part of valve assembly 50 depicted in FIGS. 2 and 3).

Although not depicted in FIG. 4, a valve actuator well known to those having skill in the art can be attached to said wellhead adapter 30 using threaded bolts 40 and operationally connected to drive shaft 37. Said actuator can be fluid powered, typically using hydraulic fluid, pneumatic air/gas power, or electrically powered, to selectively actuate (that is, open or close) a valve assembly, such as ball valve assembly 60 of valve assembly 50 depicted in FIGS. 2 and 3. Further, such actuator can permit automatic or remote controlled (including via wireless operation) opening and closing of valve assembly 60.

In an alternative embodiment, said actuator can be integrally formed with or otherwise incorporated within wellhead valve assembly 100, or component(s) thereof. In such an alternative embodiment, one or more channels or chambers can be formed within the body of a wellhead adapter for receiving said actuator, drive shaft, shaft packing and/or other components. Said components are beneficially wholly or substantially encompassed within, and protected by, the external surface of said wellhead adapter.

A Christmas tree or other wellhead component can be secured in place above said wellhead adapter 30 using upper threaded bolts 34 or other attachment means. Further, injection port 36 having inlet 36*a* for receiving a flow fitting and optional check valves extends through wellhead adapter 30 from the outer surface of said wellhead adapter to central through bore 31. Importantly, injection port 36 permits pressure testing of all valves from the pressure holding side of all valves, as well as addition of chemicals or other substances into a wellbore at or near the wellhead and below a Christmas tree thereby allowing chemicals/substances to contact the internal surfaces of said Christmas tree or its valves and protecting said Christmas tree, flowlines, production equipment, pipeline tanks, saltwater well and/or other equipment.

FIG. 5 depicts a side sectional view of an assembled wellhead valve assembly 100 of the present invention installed in connection with a conventional tubing head assembly 200, with valve assembly 60 in an open position. As depicted in FIG. 5, tubing head assembly 200 has body section 201, upper flange member 202 and central through bore 203. Transverse hold-down pin bores 204 extend from the outer surface of flange member 202 to central through bore 203. Said central through bore can include a seat profile or diameter restriction 205. When additional length is required, an optional spool extension or spool nipple extension be provided above said tubing head assembly 200; if desired, said spool extension or spool nipple extension may have radial bores (similar to transverse hold-down pin bores 204 depicted in FIG. 5) for slidably receiving hold-down pins.

Still referring to FIG. 5, said seal bushing assembly 10 can be landed on seat profile 205 within central through bore 203 of conventional tubing head assembly 200. Seal members 15, constructed of elastomeric material, rubber or other suitable sealing material, are adapted to provide an "external" pressure and/or seal against the inner surface of central through bore 203 of tubing head assembly 200.

A portion of mandrel body 51 is received within upper receptacle 12 of seal bushing assembly 10. Lug extensions 13 protruding from the inner surface of upper receptacle 12 of seal bushing assembly 10 can operationally mate with J-slot tracks 58 disposed on the outer surface of said mandrel body 51 of hanger valve assembly 50 to properly align and anchor said hanger valve assembly 50 relative to seal bushing assembly 10 and connecting rod coupling 41 depicted in FIG. 4.

Hanger valve assembly 50 beneficially has a lower threaded connection member 57 (typically a box-end threaded connection) for operational attachment to a tubing string 210. As depicted in FIG. 5, production tubing string 210 is connected to landing nipple 212 having plug receptacle or profile 213, and said landing nipple is, in turn, connected to lower threaded connection member 57. However, it is to be observed that in applications where a landing nipple is not required or desired, the upper end of production tubing 210 can connect directly to lower connection member 57. Hanger valve assembly 50 further includes internal threads 56 for receiving a backpressure valve or plug (such as, for example, a conventional backpressure valve used in connection with conventional tubing hangers).

In a preferred embodiment, said seal bushing assembly 10 also has a plurality of transverse alignment bores 14 defining tapered inner surfaces 21. Said alignment bores 14 are oriented substantially perpendicular to the longitudinal axis of central and partially through bore 11. Said transverse bores 14 are aligned with transverse hold-down pin bores 204 extending through tubing head assembly 200. Said aligned bores 204 and 14 are adapted to receive hold-down pins in a manner well known to those having skill in the art; when engaged inward toward tapered inner surfaces 21, said hold-down pins can beneficially align and anchor said seal bushing assembly 10 relative to a surrounding tubing head assembly 200.

Seal extension 17 having central through bore 21 is connected to body member 20. Internal sealing members 16 are disposed along the inner surface of central through bore 21 of seal extension 17. Said sealing members 16 are constructed of elastomeric material, rubber or other suitable sealing material, are likewise adapted to provide an "internal" pressure and/or flow seal against the outer surface of production tubing 210. In a preferred embodiment, the uppermost section(s) of production tubing 210 (nearest seal extension 17) can have a polished exterior surface to cooperate with and facilitate pressure and/or flow sealing by internal sealing members 16 and allowing hanging tubular string to be rotated and/or reciprocated within a wellbore.

When assembled in this manner, weight supported by hanger valve assembly 50 acts upon body member 20 of seal bushing assembly 10, while compression cap 23 remains substantially stationary. As a result, compression forces are imparted on seal members 15 which, in turn, energize and bias said seal members 15 radially outward to form a pressure and/or flow seal against the inner surface of bore 203 of tubing head assembly 200. Further, as noted above, hold-down pins received within aligned bores 204 and 14 can be engaged inward toward tapered inner surfaces 21 to beneficially align and anchor seal bushing (packer) assembly 10 relative to a surrounding tubing head assembly 200. Said hold-down pins can limit upward movement holding seal bushing (packer) in alignment and from being pushed from well and downward travel of body member 20, which also serves to limit or adjust the amount of compressive force exerted on compression cap 23 and seal members 15. Compression cap 23 can be preset to allow a predetermined, controlled amount of weight to be set against seal members 15 in order to avoid over compression (and damage) of seal members 15.

Hanger valve assembly 50 further includes a valve assembly 60 generally comprising rotatable ball 61, having central bore 62, that is disposed between upper ball seat 63 and lower ball seat 64. Upper retainer seat bushing 67 is disposed between said upper ball seat 63 and top sub 59. Control pin 66 is in operational engagement with ball 61, such that axial rotation of control pin 66 will, in turn, cause rotation of ball 61 about a substantially horizontal axis. As discussed above, ball 61 can be selectively rotated between a first (open) position wherein bore 62 is generally aligned with central through bore 55, and a second (closed) position wherein bore 62 is not aligned with said central through bore 55.

Wellhead adapter assembly 30 has a body section 43 and central through bore 31 extending through said body section 43. Portions of hanger valve assembly 50 and seal bushing assembly 10 are received within said central through bore 31. Wellhead adapter assembly 30 is secured to underlying tubing head assembly 200. Seal ring 230 is received within a seal ring groove between said wellhead adapter 30 and tubing head assembly 200. Sealing members 32 provide a pressure and/or flow seal against the outer surface of hanger valve assembly 50.

As discussed above, transverse bore 33 extends from the outer surface of wellhead adapter assembly 30 to central bore 31. Drive shaft 37 is rotatably disposed within said transverse bore 33. Although not depicted in FIG. 5, a valve actuator well known to those having skill in the art can be attached to said wellhead adapter assembly 30 using threaded bolts 40 and operationally connected to drive shaft 37. Said actuator can be fluid powered, typically using hydraulic fluid or pneumatic air/gas power or electrical power, to selectively actuate (that is, open or close) valve assembly 60. Spring member 65 biases ball 61 in a normally closed position Ball 61 can also be opened or closed manually, or using a hand held hydraulic pump or gas compressor.

A Christmas tree or other wellhead component can be secured in place above said wellhead adapter 30 using upper threaded bolts 34 or other attachment means. Further, injection port 36 having inlet **36*a* for receiving a fitting, flow valve 46 and/or check valve(s) 45 extends through wellhead adapter 30 from the outer surface of said wellhead adapter to central through bore 31. Check valve 45 permits flow into injection port 36 via inlet 36*a***, but not flow in the reverse direction out of said injection port unless check valves are intentionally removed for internal testing during installation.

Figure 6:
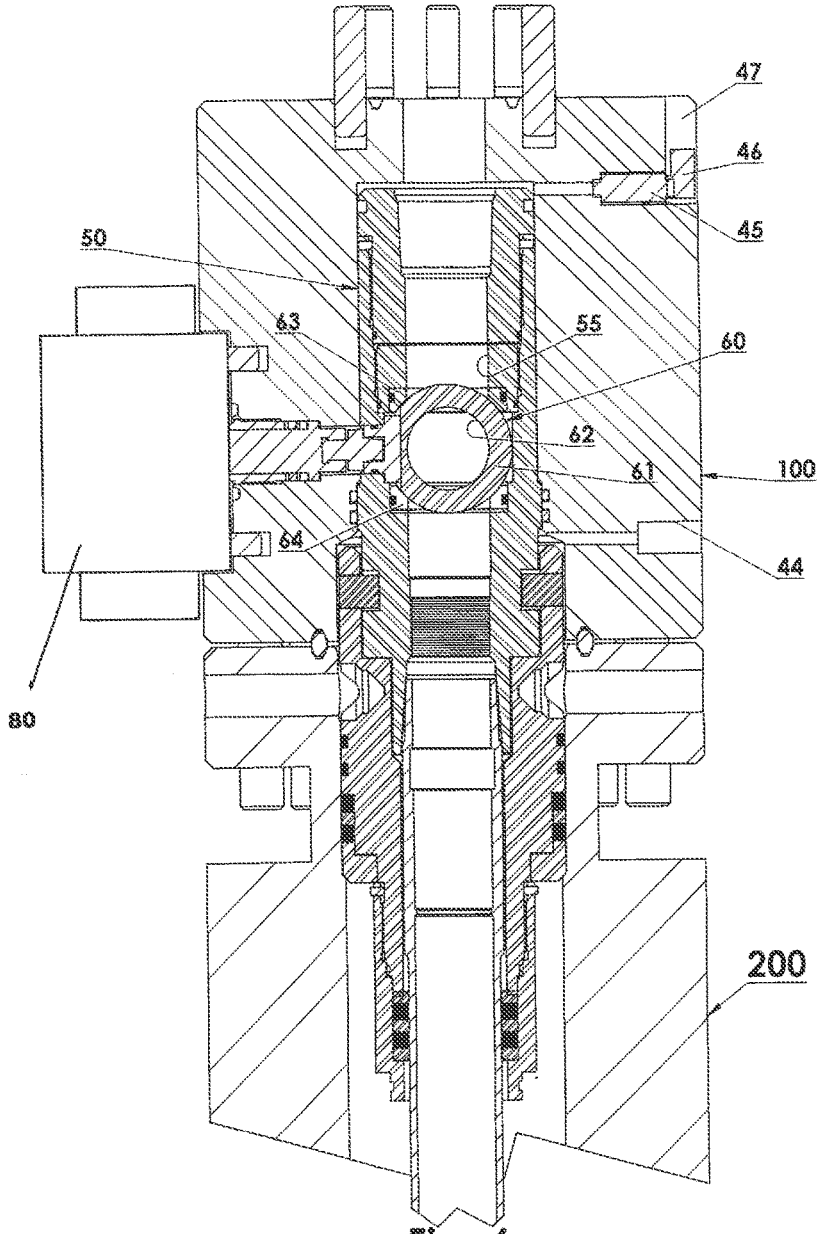
FIG. 6 depicts a side sectional view of an assembled wellhead valve assembly of the present invention installed in connection with a conventional tubing head assembly with a valve assembly in a closed position.

FIG. 6 depicts a side sectional view of an assembled wellhead valve assembly 100 of the present invention installed in connection with a conventional tubing head assembly 200 as depicted in FIG. 5; however, unlike the view depicted in FIG. 5, valve assembly 60 is depicted in FIG. 6 in a closed position. Automated actuator 80 can be used to shift valve assembly 60 between open and closed positions in a manner well known to those having skill in the art. As such, ball 61 is shifted such that central bore 62 of ball 61 is not in fluid/pressure communication with through bore 55 of hanger valve assembly 50 in said closed position. In this position, ball 61 cooperates with upper ball seat 63 and lower ball seat 64 to form a flow barrier and pressure seal across said central through bore 55. A lower inner body and seal ring test port 44 of FIG. 5 can be provided through wellhead adaptor body 43 to permit pressure testing void area of seal ring 230, bushing exterior seals 15, interior seal 16, wellhead adapter interior seals 32 and any connection residing within such area after coupling of wellhead adapter assembly 100 and tubing head assembly 200.

Figure 7:
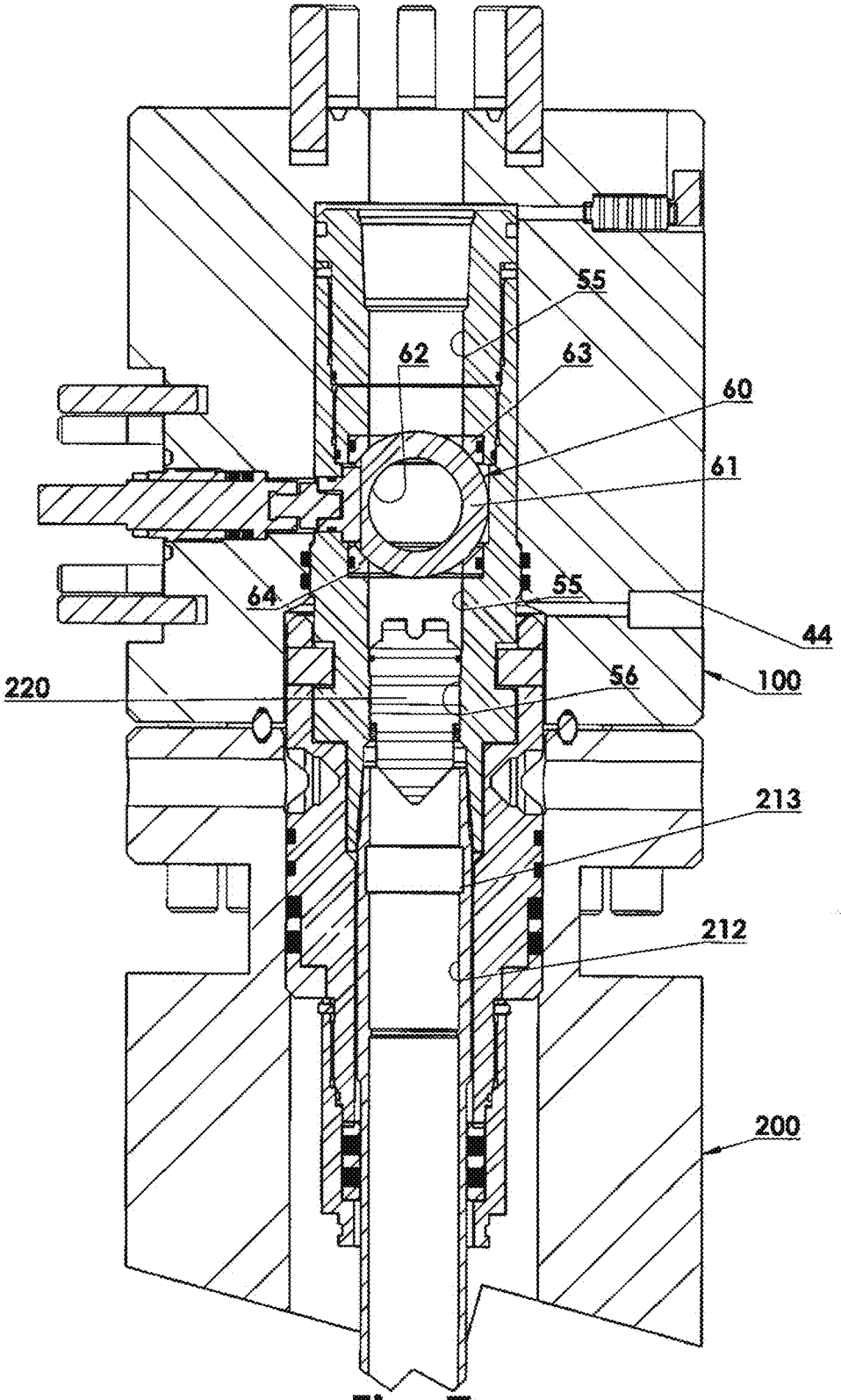
FIG. 7 depicts a side sectional view of an assembled wellhead valve assembly of the present invention installed in connection with a conventional tubing head assembly with a valve assembly in a closed position and a backpressure valve installed.

FIG. 7 depicts a side sectional view of an assembled wellhead valve assembly 100 of the present invention installed in connection with a conventional tubing head assembly 200 having a valve assembly 60 in a closed position and a backpressure valve 220 installed. As depicted in FIG. 7, ball 61 is shifted such that central bore 62 of ball 61 is not in fluid/pressure communication with through bore 55 of hanger valve assembly 50. Specifically, backpressure valve 220 is installed within internal threads 56 in internal bore 55. In a preferred embodiment, when so installed, said backpressure valve 220 is positioned below ball 61.

Figure 8:
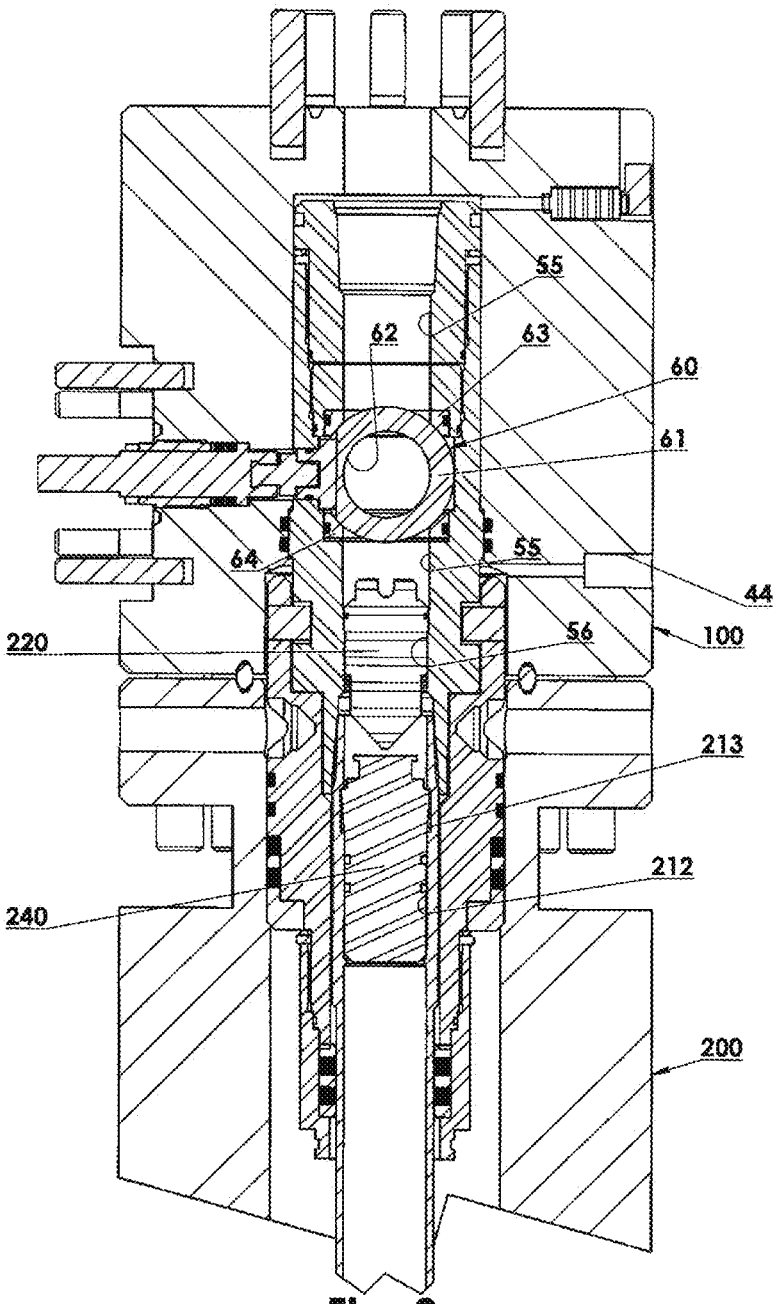
FIG. 8 depicts a side sectional view of an assembled wellhead valve assembly of the present invention installed in connection with a conventional tubing head assembly with a valve assembly in a closed position, as well as a backpressure valve and downhole plug installed.

FIG. 8 depicts a side sectional view of an assembled wellhead valve assembly 100 of the present invention installed in connection with a conventional tubing head assembly 200 with a valve assembly 60 in a closed position, as well as a backpressure valve 220 and downhole plug 240 installed. Ball 61 is shifted such that central bore 62 of ball 61 is not in fluid/pressure communication with through bore 55 of hanger valve assembly 50. Additionally, plug 240 is installed within landing profile 213 of landing nipple 212, while backpressure valve 220 is installed within internal threads 56 in internal bore 55. In a preferred embodiment, when so installed, said plug 240 and backpressure valve 220 are both positioned below ball 61.

As depicted in FIGS. 7 and 8, the wellbore valve assembly 100 of the present invention can be used in conjunction with a conventional backpressure valve 220 or tubing plug 240, including as a safety backup to provide an additional flow and pressure barrier. In such applications, said conventional backpressure valve or tubing plug can be installed through a Christmas tree when valve assembly 60 (and, more specifically, ball 61 thereof) is in an open configuration. When desired, said valve assembly 60 can be closed above said backpressure valve and/or plug to add an additional flow barrier and pressure seal within a well.

Figure 9:
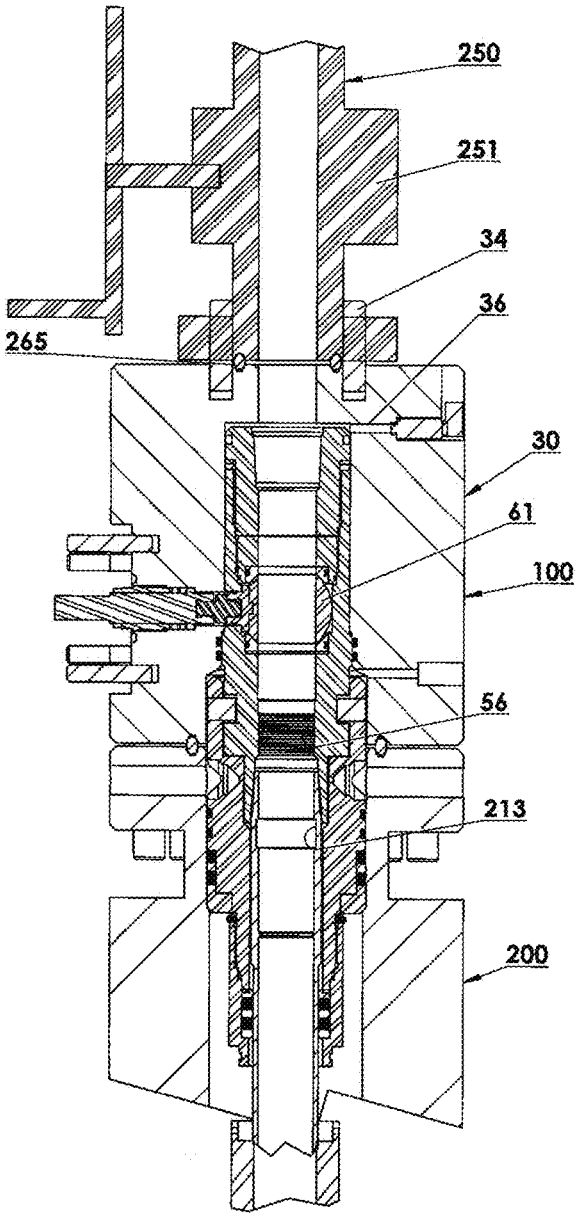
FIG. 9 depicts a side sectional view of an assembled wellhead valve assembly of the present invention installed in connection with a conventional tubing head assembly and Christmas tree.

FIG. 9 depicts a side sectional view of an assembled wellhead valve assembly 100 of the present invention installed in connection with a conventional tubing head assembly 200 and Christmas tree assembly 250. As depicted in FIG. 9, Christmas tree assembly 250 can attach to the upper surface of wellhead adapter assembly 30 using upper threaded bolts 34 and seal by seal ring 265.

Figure 10:
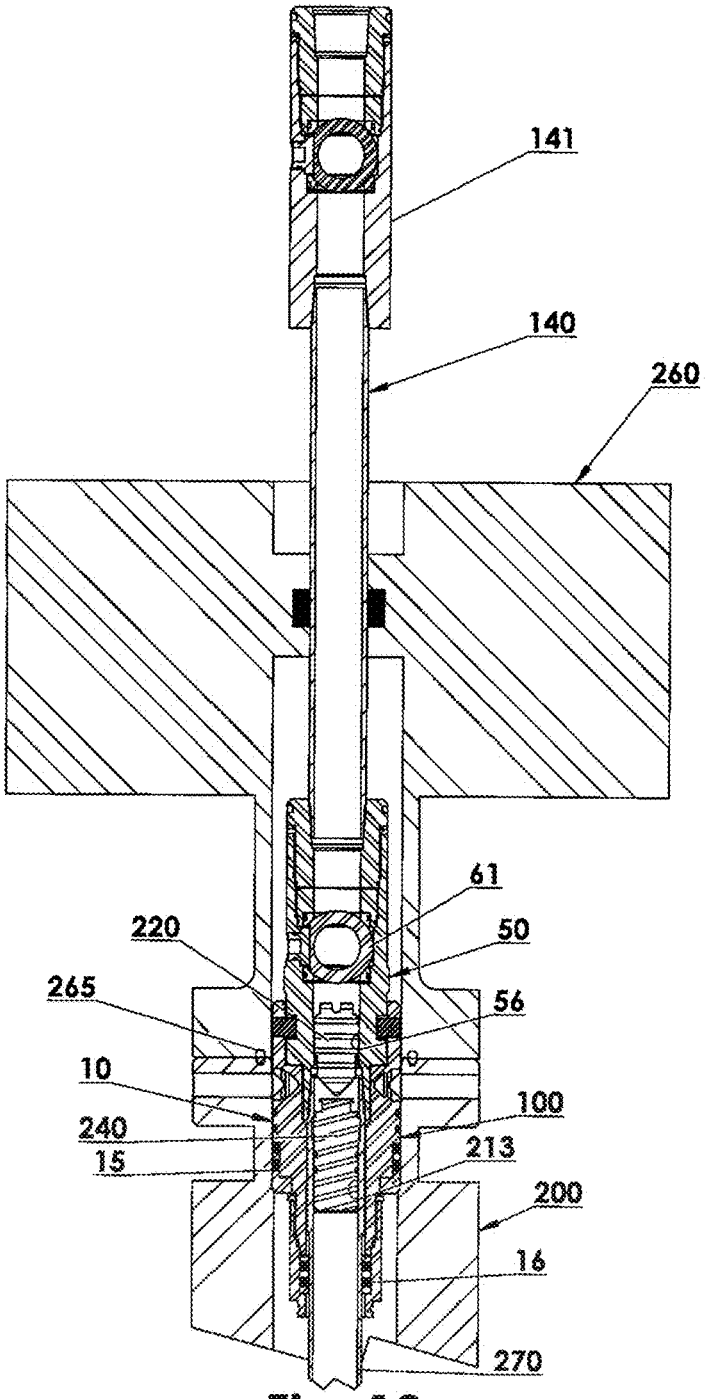
FIG. 10 depicts a side sectional view of an assembled wellhead valve assembly of the present invention installed in connection with a conventional tubing head assembly and blowout preventer assembly.

FIG. 10 depicts a side sectional view of an assembled wellhead valve assembly 100 of the present invention installed in connection with a conventional tubing head assembly 200 and blowout preventer assembly 260. As depicted in FIG. 10, blowout preventer assembly 260 can attach to the upper surface of tubing assembly 200 (typically using threaded bolts or other conventional attachment means) and sealed by seal ring 265. In this configuration depicted in FIG. 10, a wellhead adapter (such as wellhead adapter assembly 30 depicted in FIG. 9) is not utilized.

Further, as depicted in FIG. 10, a section of landing string (tubing or workstring) 140 is connected to the upper end of wellhead valve assembly 50 and can be used to raise and lower said wellhead valve assembly 50, Seal Bushing assembly 10 and any equipment attached thereto within a well. Blowout preventer assembly 260 can be used to selectively close against the outer surface of landing string 140 to provide a barrier and seal against flow and pressure in the annular space between the inner surface of said blowout preventer assembly 260 and the outer surface of landing string 140. Additionally, an upper valve assembly 141 can be provided on the upper end of landing string 140; although other valve assemblies can be utilized for this purpose, said upper valve assembly 141 can comprise a ball-type valve commonly referred to as a "TIW" valve. FIG. 10 illustrates when present invention is used in conjunction with the blowout preventer assembly 260 and upper valve assembly 141 then well has multiple barriers internal of tubing or workstrings and annulus side of wellbore and blowout preventer with tubulars hanging in well.

Figure 11:
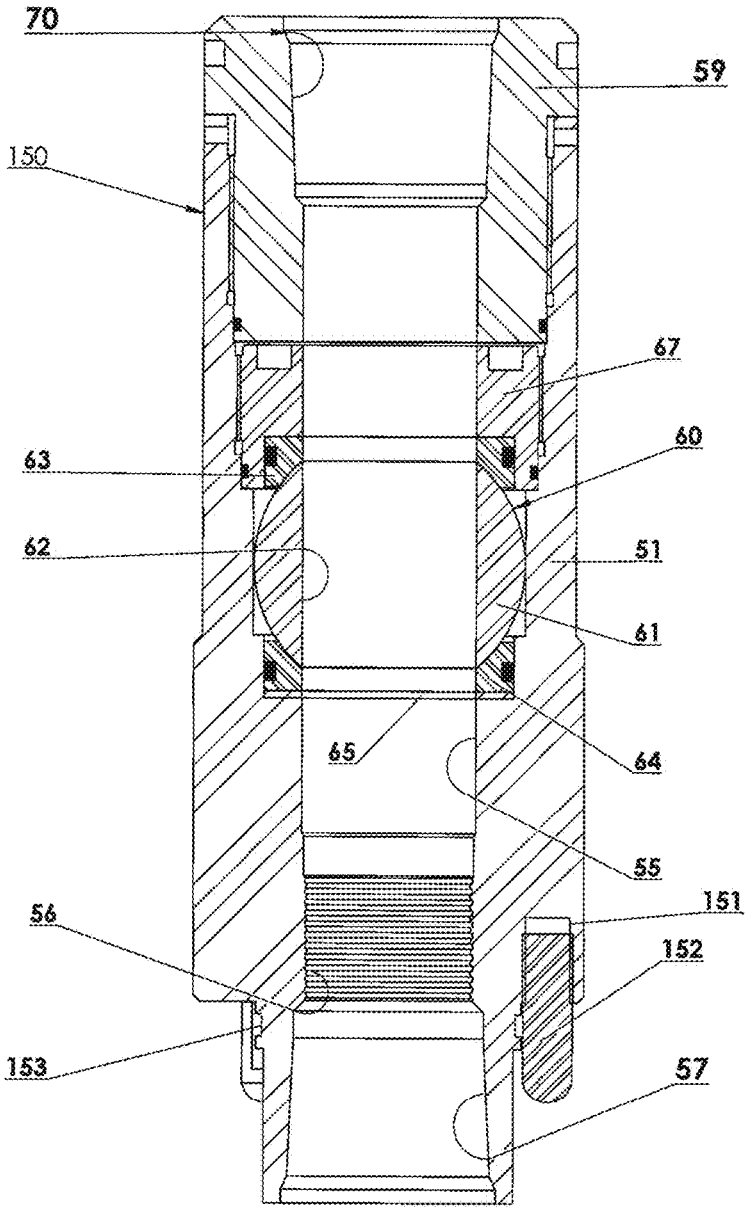
FIG. 11 depicts a side sectional view of an alternative embodiment of a hanger valve assembly of the present invention.

FIG. 11 depicts a side sectional view of an alternative embodiment of a hanger valve assembly 150 of the present invention. Reference numerals in FIG. 11 common to FIG. 2 reflect the same or substantially similar components as depicted in FIG. 2. Alternative embodiment hanger valve assembly 150 includes bore 151 disposed within mandrel body 50. Alignment pin locator 151 is disposed within said bore 151; in a preferred embodiment, said alignment pin locator 151 is oriented substantially parallel to the longitudinal axis of central through bore 55. Unlike the embodiment of valve hanger assembly 50 depicted in FIG. 2, alternate seal bushing assembly 10 does not include "J" slot track (such as "J" slot track 58 depicted in FIG. 2).

Figure 12:
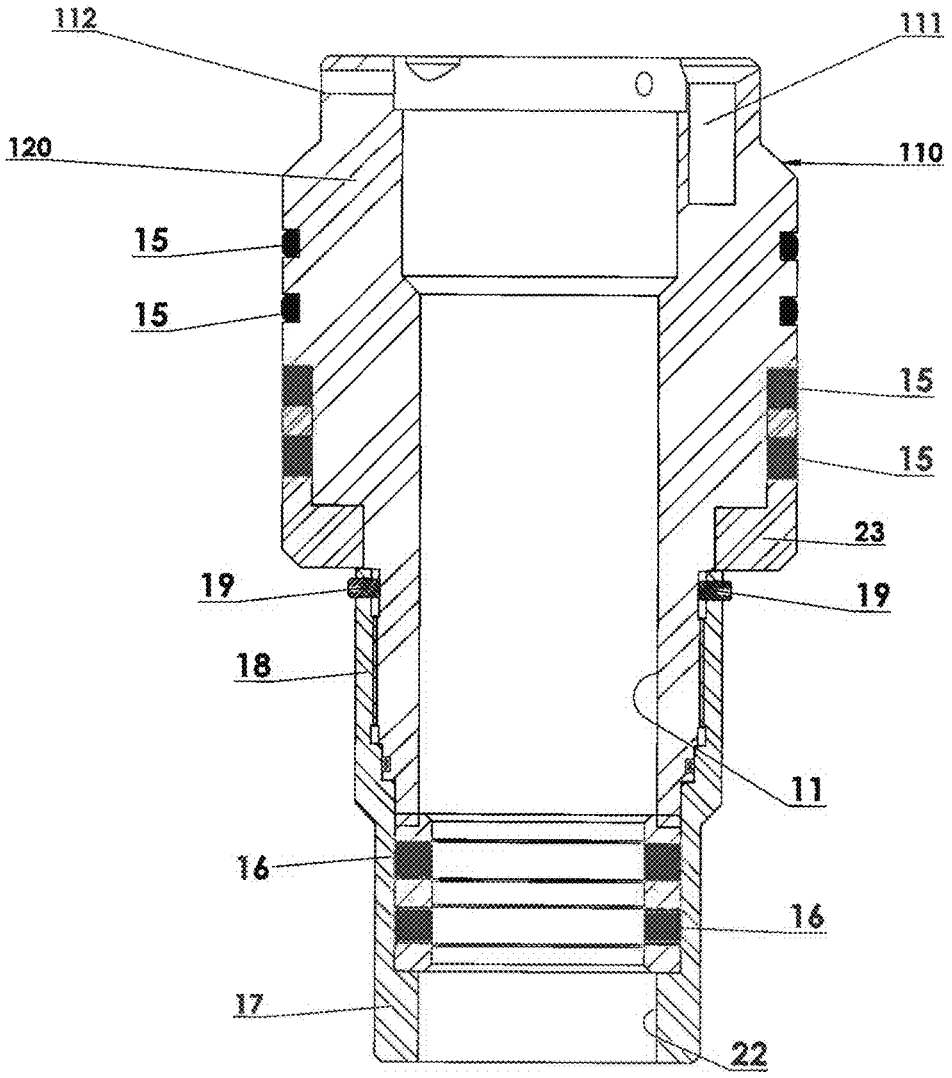
FIG. 12 depicts a side sectional view of an alternative embodiment of a seal bushing (packer) assembly of the present invention.

FIG. 12 depicts a side sectional view of an alternative embodiment of a seal bushing assembly 110 of the present invention. Reference numerals in FIG. 12 common to FIG. 1 reflect the same or substantially similar components as depicted in FIG. 1. Alternate seal bushing assembly 110 has body member 120 having alignment bore 111; said alignment bore 111 is oriented substantially parallel to the longitudinal axis of central through bore 11. Unlike the embodiment of seal bushing assembly 10 depicted in FIG. 1, alternate seal bushing assembly 110 does not include lug extensions (such as lug extensions 13 depicted in FIG. 1).

Although not visible in FIG. 12, a plurality of alignment bores 111 are disposed around the outer circumference of central bore 11 of said alternative embodiment seal bushing assembly 110. Thus, when alternative embodiment hanger valve assembly 150 (depicted in FIG. 11) is coupled with alternative embodiment seal bushing assembly 110 (depicted in FIG. 12), alignment pin locator(s) 151 of hanger valve assembly 150 are received within alignment bore(s) 111, and act to properly align said alternative embodiment hanger valve assembly 150 and alternative embodiment seal busing assembly 110 relative to each other.

Further, transverse shear pin bore 112 can extend through body member 120 in an orientation substantially perpendicular to the longitudinal axis of through bore 11. A pin or screw disposed through said shear pin bore 112, and partially received within aligned bore 153 of alternative embodiment hanger assembly 150 (depicted in FIG. 11) can serve to secure said components together, but can shear or otherwise separate to release said hanger valve assembly 150 from seal bushing assembly 110 in response to a predetermined axial force.

Figure 13:
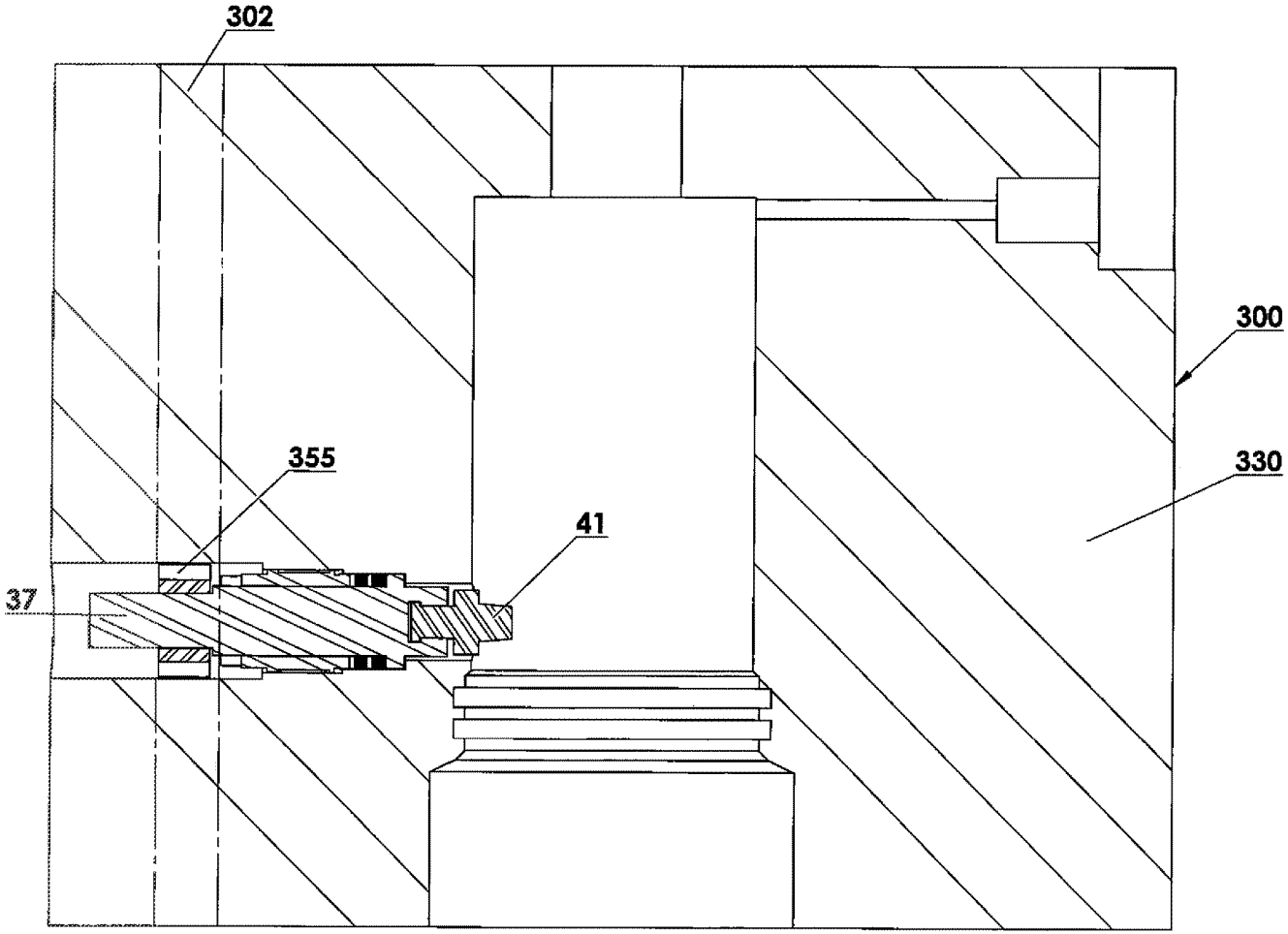
FIG. 13 depicts a side sectional view of a second alternative embodiment of the wellhead valve assembly of the present invention including an optional internal valve actuator assembly.

FIG. 13 depicts a side sectional view of a second alternative embodiment wellhead valve assembly 300 of the present invention including an optional internal valve actuator assembly. As depicted in FIG. 13, said actuator can be integrally formed with or otherwise incorporated within wellhead valve assembly 300, or component(s) thereof, such as modified wellhead adapter 330. In such an alternative embodiment, one or more channels 302 or chambers 302 can be formed within the body of said wellhead adapter 330 for receiving said actuator of FIG. 14, drive shaft 337, shaft packing 339, drive shaft gear 355 of FIG. 13 and/or other components FIG. 14 et al.

Figure 14:
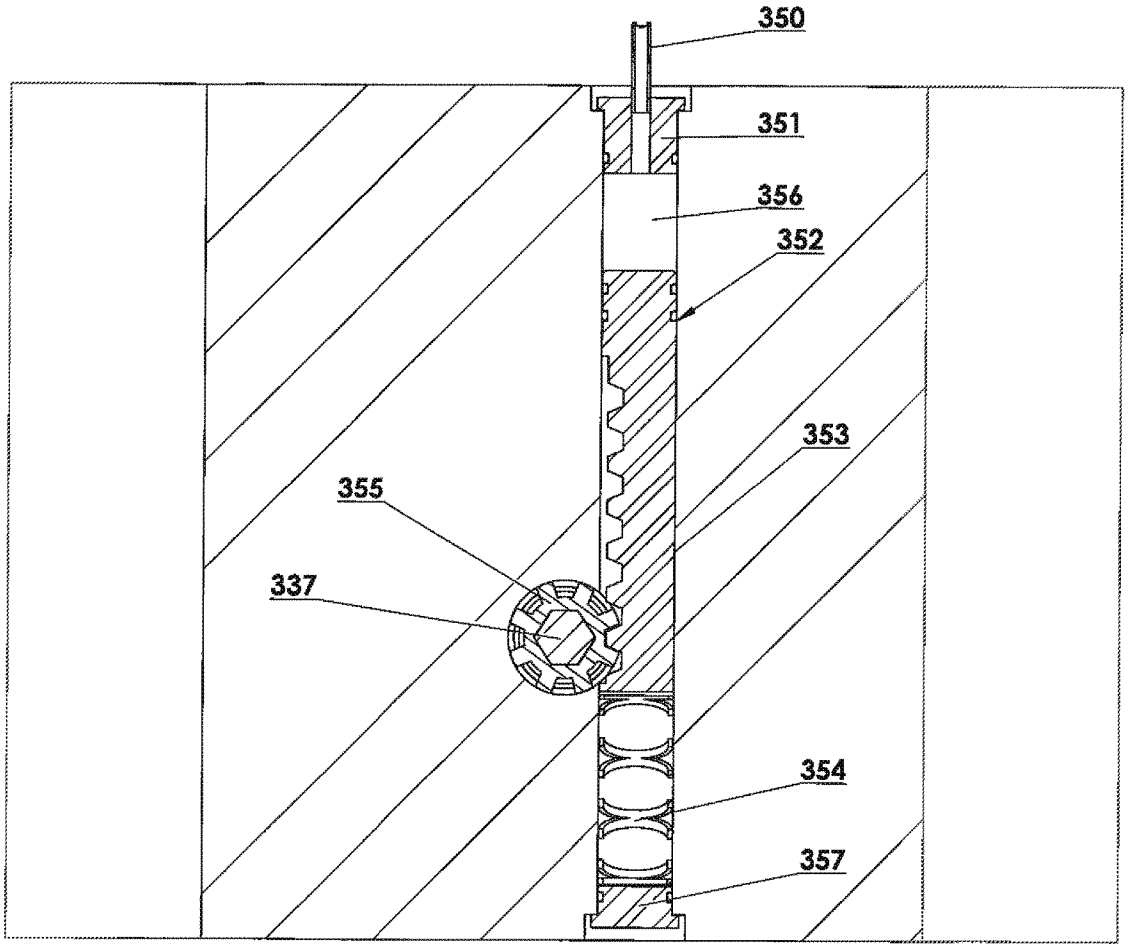
FIG. 14 depicts an alternative view of the actuator assembly depicted in FIG. 13.

As shown in FIG. 13, said components are beneficially wholly or substantially encompassed within, and protected by, the external surface of said alternative wellhead adapter 330. Said internal actuator embodiment is significantly less likely to be affected by the surrounding environment (such as, for example, in marine or wetlands installations that are wholly or partially under water), while also being protected against inadvertent damage or collision. Moreover, said internal actuator embodiment can be more versatile, in that it can frequently be installed in areas that do not have sufficient space to receive a conventional actuator. FIG. 14 as shown illustrates hydraulic and pneumatic model showing Pressured fluid or compressed gas/air line 330, Inlet cap 331, chamber 356, gear rod seals 352, gear rod 353, recoil spring 354, adjustable end cap 357, drive shaft gear 355 and drive shaft 37. Such components working in conjunction as pressure is applied into chamber 356, exerting force on gear rod 353, thus rotating the drive shaft gear 355 and rotating the drive shaft 337 coupled to the alternative embodiment wellhead assembly body 330 and coupled with connecting rod coupling 41 and to control pin 66 and to ball 61 providing for opening and closing of ball 61. Spring 354 acts to reverse gear, shaft, coupling, pin and ball to make present invent automatically close ball when pressure is released from chamber 356, thus making present invention be a normally closed or shut off system. Although not depicted said actuator can also be electrically powered.

Such additional flow barrier and pressure seal provided by the wellhead valve assembly of the present invention is particularly advantageous in circumstances when a Christmas tree is removed such as, for example, prior to performing a work over or recompletion operation FIG. 14*s*. In such situations, there is a period of time between removal of said Christmas tree and installation of a blowout preventer assembly, when well control is primarily, if not exclusively, dependent upon a backpressure valve and/or downhole plug. Should said backpressure valve or downhole plug fail or become dislodged, a well could blow out causing catastrophic damage to surrounding property, personnel and the environment. By contrast, the wellhead valve assembly can be quickly and easily shifted to a closed position prior to removing a Christmas tree, thereby adding an additional means of protection and safety so such operations.

When wellhead valve assembly 100 is installed and valve assembly 60 is in the open position (as depicted in FIG. 5), the aligned through bores of wellhead adapter assembly 30, hanger valve assembly 50 (including bore 62 of ball 65) and seal bushing assembly 10 cooperate to form a continuous flow pathway between production tubing 210 and a Christmas tree, BOP assembly or other equipment disposed above wellhead adapter assembly 30. Further, said cooperating through bores of wellhead valve assembly 100 beneficially comprise inner diameters at least as large as the inner diameter dimension of inner bore 211 of production tubing 210; as a result, no diameter restrictions exist through said wellhead valve assembly 100 (which could negatively impact wireline, coiled tubing or other intervention operations passing through said wellhead valve assembly 100), while ensuring that any unintentionally dropped backpressure valve 220 or plug 240 would not fall into said bore 211 of production tubing 210 (and, thus, downhole in a well).

As an added safety feature, in the event of failure of a plug or backpressure valve, such plug or valve will not be forced upward uncontrollably due to well pressure when ball 61 of valve assembly 60 is in a closed position. Rather, upward movement of such plug or backpressure valve is limited by a closed ball 61 of valve assembly 60. In such circumstances, a plug or backpressure valve is trapped by closed ball 61 and prevented from blowing out of the well (possibly causing death or injury to personnel and/or damage to the environment and property), while the well remains secure and under control.

Referring back to FIG. 5, the design of the present invention permits installation of wellhead valve assembly 100 in a wellhead using a pup joint or landing string of drill pipe or other work string connected to upper connection 70 of hanger valve assembly 50. Left hand threaded connection 71 of seat retainer bushing 67 and set screw 69 between top sub 59 and hanger mandrel 51 ensures that said members will not be disconnected when such a pup joint or landing string is intentionally unscrewed from said upper connection 70, such as when removal of the pup joint or landing string is desired. In such circumstances, the present invention permits convenient seating and/or unseating of retrievable packers, as well as stinging in and out of permanent packers. This permits fluid circulation (such as when killing a well prior to a work over or when circulating and conditioning completion fluids) while still having a valve in the string in order to shut in the well if needed.

Thus, the wellhead valve assembly of the present invention can serve as a primary shut-off valve for added safety, such as when working on wellhead control valves, when storm control shutoff is needed, during construction, rigging up or rigging down of a rig over a well or a nearby a well, and/or when emergency shutdown is required.

The wellhead valve assembly of the present invention can also be used as secondary or "back up" valve for well control purposes. By way of illustration but not limitation, the wellhead valve assembly of the present invention can be used as a back up safety valve in the event of a thread or seal failure, especially during blow out preventer testing; as a primary and/or backup valve for emergency tree leaks or repairs of wellhead control and safety valves (especially a bottom master valve); as a backup or temporary shut-in valve positioned under a blowout preventer assembly to repair or replace said blowout preventer assembly; as a backup to a blowout preventer assembly, such as at night when rig operations are suspended or conducted only during daylight; and/or as extra shut in option in the event of flooding, hurricane, fire or weather-related shutdown event.

The wellhead valve assembly of the present invention can also be used for pressure testing purposes, including certain testing that must be performed in accordance with applicable law or regulatory requirements. By way of illustration, but not limitation, closing of valve assembly 60 FIG. 5 permits pressure testing of a Christmas tree from below tree valves including, without limitation, via injection port 36, which is the primary pressure and/or flow sealing direction for said tree valves.

Referring to FIG. 9, in one testing arrangement utilizing wellhead valve assembly 100 of the present invention, a backpressure valve can optionally be set within back pressure thread 56 or plug set in plug profile 213. Ball 61 can be shifted to a closed position, while master valve 251 of Christmas tree assembly 250 can also be closed. Fluid can be pumped through injection port 36 to fill any void spaces between ball 60 and master valve 251 in order to pressure test said valves. In this manner, master valve 251 of Christmas tree 250 (or other valves of said Christmas tree) can be tested from below said tree valves, which is the primary pressure and/or flow sealing direction for said tree valves.

Corrosion in wells frequently occurs in the upper portion of tubing strings. Ball 61 and seats 63 and 64 and hanger joints of FIG. 5 are constructed of highly corrosive-resistant materials and are enclosed within an interior (protected) valve assembly 60. Thus, if a well has holes in the tubing below the wellhead assembly, then the well can still remain under control during the period of time when a Christmas tree is removed, a blowout preventer assembly is installed and fluids are pumped to kill the well. If intervention operations such as wireline, coil tubing, snubbing, or the like are used in the well, wellhead valve assembly 100 will still permit such operations to be performed while also serving as a secondary safety valve.

Further, the wellhead valve assembly also permits testing of a blowout preventer assembly at designated times or between required scheduled testing without pulling drill pipe or work string entirely out of the well. Pipe can be hung in a safe mode while testing blowout preventers and other surface safety equipment, thus creating a safer environment for well control during well maintenance and drilling operations.

Referring to FIG. 10, in this configuration wellhead adapter 30 of FIG. 9 is not installed; rather hanger valve assembly 50 and seal bushing assembly 10 are installed within tubing head assembly 200. Blowout preventer assembly 260 is installed on the upper surface of tubing head assembly 200. When utilized during drilling or workover operations, drill pipe, tubing or workstrings 270 can remain hanging in a well and need not be fully retrieved from said well—this secures said well and allows for circulation at near bottom of the well while blowout preventer assembly 260 is being tested.

After pressure or other testing of blowout preventer assembly 260 is completed, hanger valve assembly 50 can be removed from the well until closed ball 61 is out of the well, while seal bushing assembly 10 remains secured in the well, allowing seal members 15 and 16 to keep well pressure secured. After the well has been circulated with appropriate drilling fluids, then seal bushing assembly 10 can be safely removed. In this position tubulars hanging below present invention can but not limited to the rotation and reciprocated to allowing free movement of pipe during fishing, pipe recovery efforts, setting of packers, etc. a shear pin set screw 24 of FIG. 5 can be inserted through seal extension cap 17 of FIG. 5 and a stop collar 214 of FIG. 5 is installed just below the hanger joint to allow for running and setting of seal bushing 10 of FIG. 5 and also provides as a stop so that tubing cannot be pushed past a designated and controlled limit from the well. Said stop collar 214 can also act as a bumper jar if the need arises from the seal bushing assembly 10 of FIG. 5 being stuck in the tubing head 200 of FIG. 5.

Said wellhead valve assembly can also be used as a tree saver tester for hydraulic fracturing operations at the time of tree saver installation and prior to initiation of fracturing operations; as an automated safety system for fracturing operations in the event of release of a tree saver stinger; and as a primary valve for snubbing or coil tubing operations with or without wellhead tree valves. Further, the wellhead valve assembly of the present invention allows for the removal of rental valve(s) or equipment for fracturing or stimulation operations and installation of production wellhead assembly after fracturing or well stimulation without the need for loading or killing a well or placing a downhole plug(s) in order to install a final production wellhead.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A wellhead valve assembly for a well equipped with a pipe string comprising:

a) a tubing head having a through bore;

b) a seal bushing assembly having a through bore, wherein said seal bushing assembly is at least partially disposed in said through bore of said tubing head;

c) a first seal member adapted to form a pressure seal between said seal bushing assembly and said tubing head;

d) a hanger assembly having a central flow bore and at least partially disposed in said through bore of said seal bushing assembly, wherein said hanger assembly is operationally connected to said pipe string and said pipe string is at least partially disposed through said through bore of said seal bushing assembly;

e) a wellhead adapter member defining an internal space, wherein said wellhead adapter member is connected to said tubing head;

f) a valve disposed in said hanger assembly adapted to selectively control flow through said flow bore of said hanger assembly, wherein said valve is positioned above said tubing head and within said internal space of said wellhead adapter, and can alternate between a first open position and a second closed position;

g) a receptacle having internal threads for receiving a backpressure valve in said central flow bore of said hanger assembly, wherein said threaded receptacle is disposed below said valve;

h) a second seal member adapted to form a pressure seal between said pipe string and said seal bushing assembly, wherein said pipe string is configured to selectively travel through said bore of said seal bushing assembly while maintaining said pressure seal.

2. The wellhead valve assembly of claim 1, wherein said hanger assembly is releaseably attached to said seal bushing assembly.

3. The wellhead valve assembly of claim 2, further comprising a third seal member adapted to form a pressure seal between said hanger assembly and said wellhead adapter.

4. The wellhead valve assembly of claim 1, further comprising an automated actuator configured to operate said valve.

5. The wellhead valve assembly of claim 4, further comprising a drive shaft extending from said automated actuator to said hanger assembly through a bore in said wellhead adapter, wherein said drive shaft is adapted to operationally engage said valve.

6. The wellhead valve assembly of claim 5, further comprising packing disposed around said drive shaft, wherein said packing is substantially contained within said bore.

7. The wellhead valve assembly of claim 4, wherein said automated actuator is hydraulically or pneumatically powered.

* * * * *